US005791509A

United States Patent [19]

Rush et al.

[11] Patent Number: 5,791,509

[45] Date of Patent: Aug. 11, 1998

[54] UNIFORM STACKING CUP LID

[75] Inventors: Jonathan Edward Rush, Phillipsburg, N.J.; Margaret Virginia Graver, Beth; Michael Thomas Grolemund, Easton, both of Pa.

[73] Assignee: James River Corporation of Virginia, Richmond, Va.

[21] Appl. No.: 571,304

[22] Filed: Dec. 12, 1995

[51] Int. Cl.[6] ..... B65D 43/03

[52] U.S. Cl. ..... 220/781; 220/796; 220/380; 206/508; 206/509; 206/519

[58] Field of Search ..... 220/306–307, 220/380, 781, 796; 206/508, 509, 511, 519, 520

[56] References Cited

U.S. PATENT DOCUMENTS

| | | | |
|---|---|---|---|
| 3,091,360 | 5/1963 | Edwards | 206/520 |
| 3,112,841 | 12/1963 | Martinelli . | |
| 3,339,792 | 9/1967 | Biglin . | |
| 3,353,708 | 11/1967 | Davis . | |
| 3,441,173 | 4/1969 | Edwards | 206/520 |
| 3,722,731 | 3/1973 | McCormick et al. | 220/380 X |
| 3,773,207 | 11/1973 | Dokoupil et al. | 220/380 X |
| 3,893,567 | 7/1975 | Davis et al. . | |
| 3,967,731 | 7/1976 | Boduch . | |
| 4,156,483 | 5/1979 | Day | 206/520 X |
| 4,165,020 | 8/1979 | Hoselton | 220/380 X |
| 4,194,645 | 3/1980 | Zabner et al. | 220/380 X |
| 4,215,797 | 8/1980 | Chen . | |
| 4,225,045 | 9/1980 | Rayner et al. | 206/508 |
| 4,275,815 | 6/1981 | Davis . | |
| 4,421,244 | 12/1983 | Van Melle . | |
| 4,687,117 | 8/1987 | Terauds . | |
| 4,703,857 | 11/1987 | Jahnen et al. . | |
| 4,817,801 | 4/1989 | Schwaikert | 220/380 X |
| 4,826,039 | 5/1989 | Landis | 220/380 |
| 4,872,586 | 10/1989 | Landis | 220/380 X |
| 5,105,947 | 4/1992 | Wise | 206/519 |
| 5,377,861 | 1/1995 | Landis . | |
| 5,540,349 | 7/1996 | Phillips | 220/380 X |

FOREIGN PATENT DOCUMENTS

| | | | |
|---|---|---|---|
| 288914 | 2/1963 | Netherlands | 206/520 |

*Primary Examiner*—Allan N. Shoap
*Assistant Examiner*—Nathan Newhouse
*Attorney, Agent, or Firm*—Sixbey, Friedman, Leedom & Ferguson, PC; Charles M. Leedom, Jr.; Donald R. Studebaker

[57] ABSTRACT

A thin walled lid formed of a thermoplastic material having a generally circular center portion and an outer rim portion which fits over the cup bead and includes an integral peripheral skirt which makes up the outer side wall of the lid is disclosed. Located between the rim portion and the center portion is a recess or annular trough with an inner wall and an outer wall. The outer wall is separated into two shelves and three vertical sections. The lower shelf serves as a receiver ring upon which the lid above rests. The short vertical section located above the receiver ring effectively prevents any lateral movement of the lid above, while the lowest wall section forms the stacking ring and generally has a negative slope toward the lid skirt. Spaced periodically around the circumference of the stacking ring are positive draft flutes which have a positive slope away from the skirt and toward the center of the lid. The recess has a generally flat bottom which connects the stacking ring to the inner wall. The corner of the lid where the stacking ring and the recess bottom join rests in the receiver ring of the next lower lid in the stack to provide uniform nesting and full circumferential support. The inner wall of the recess has a positive slope and connects the bottom of the recess with the generally flat center portion. In an alternative embodiment, the negative stack ring and the receiver ring are provided on the inner wall of the lid. There are no positive draft flutes provided, in that as the plastic cools during the thermoforming process the negative stack ring will shrink towards the lid center a sufficient distance to allow the lid to clear the undercut of the mold during stripping.

24 Claims, 6 Drawing Sheets

FIG. 9
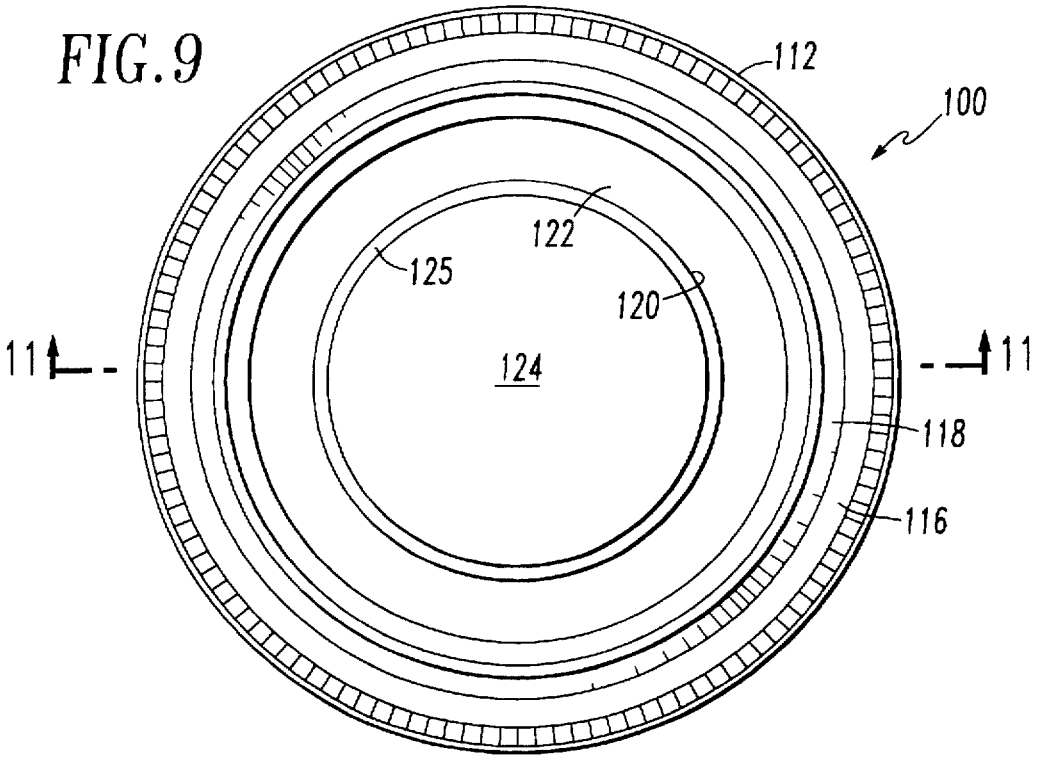
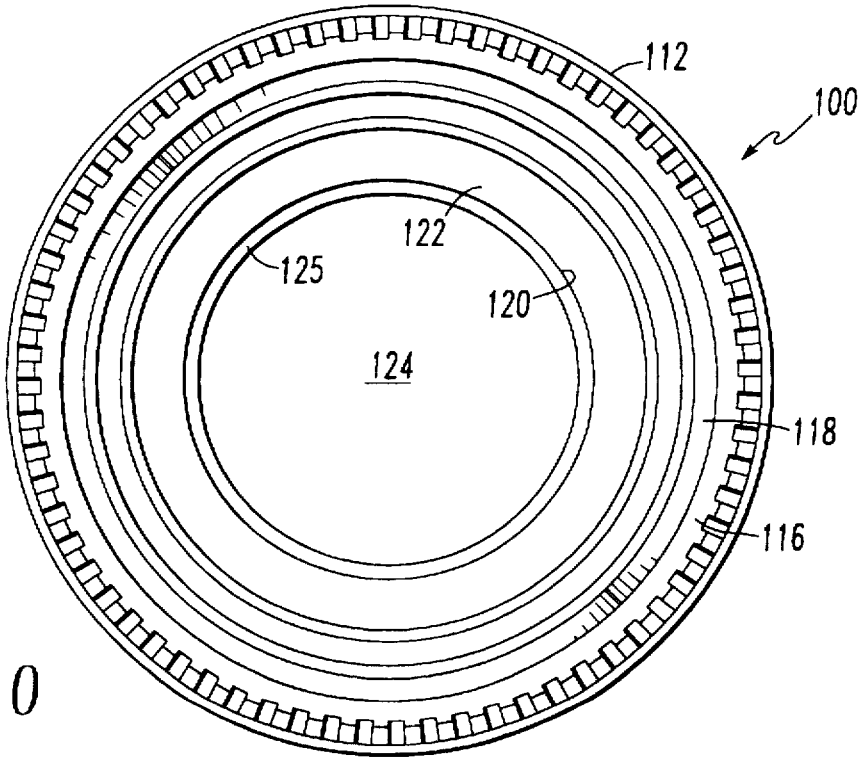
FIG. 10

UNIFORM STACKING CUP LID

TECHNICAL FIELD OF THE INVENTION

The present invention relates to disposable, thin-wall plastic lids, which are free nesting and positive stacking. More particularly, this invention relates to an improved thermoformed lid with a negative stack ring which obviates the need for a secondary stripping or ejection mechanism to remove the lid from its mold.

BACKGROUND OF THE INVENTION

Thin-wall plastic lids are commonly used in fast food establishments, vending machines and automatic filling equipment. The abundant use of lids of this type requires that a plurality of such lids be capable of being formed in a nested stack having unsupported lateral stability while preventing individual lids from jamming when the stack is subjected to axial loads. This stacking arrangement allows the lids to be maintained in an evenly spaced relationship during storage, and easily dispensed when required for use.

It is known to use negative stack rings for stacking thin-walled plastic items. U.S. Pat. No. 3,091,361 to Edwards discloses a negative stack ring for a cup, and U.S. Pat. No. 3,112,841 to Martinelli disclose a negative stack ring in use with a lid. The negative stack ring helps to create a stable, uniform stack, which has good lateral stability.

One process for manufacturing thin-wall plastic lids is thermoforming, where a sheet of thermoplastic resin is softened by heating, clamped in a frame, and then acted on solely or in combination by forces which push or pull the sheet conforming it to a mold. The thermoforming process requires stripping the lid from the mold when the process is complete. The undercut associated with the negative stack ring makes removal from the mold difficult. Deformation and stress failure of the plastic material is a common problem, and lids with a negative stack ring such as those noted hereinabove frequently invert or turn inside out when stripped from the mold. To avoid these material failures a special secondary stripping or ejection mechanism can be added to the tool. These additional tooling mechanisms require major modifications to the existing process adding expense and time to the present thermoforming process. One embodiment of the present invention solves the stripping problem by making changes to the mold and the design of the lid.

U.S. Pat. No. 3,091,361 to Edwards issued May 28, 1963 discloses a cup with a negative stack near its bottom. Cups however, because of their larger size and thicker walls, do not experience the same material deformations during stripping as the thin walled plastic lids.

U.S. Patent No. 3,112,841 to Martinelli issued Dec. 3, 1963 discloses a lid with a negative stack ring. The negative stacking ring includes stacking lugs which protrude toward the center of the lid thereby creating a larger landing surface to receive the ring of the lid placed thereon. The stacking lugs are not positively sloped, and therefore they do not serve to assist in the removal from the mold. In fact, the stacking lugs make removing the lid from the mold more difficult, because in the region of the stacking lugs the side wall has a larger negative taper, effectively securing the lid to the mold. Additionally, the process used to manufacture the lids is either a compression or injection molding process and not a thermoforming process.

U.S. Pat. No. 4,421,244 to Van Melle issued Dec. 20, 1983 discloses a thin-walled lid with a skirt portion that has a plurality of outwardly extending projections. These projections provide the surface upon which the lids rest during the normal stacking configuration, preventing the lids from locking together. The undercuts or projections on the outer skirt portion allow the lid to strip easier from the mold, without degrading its ability to secure to the bead rim of its container. The stacking arrangement of the lids is inconsistent, because the projections of the upper and lower lids may align, allowing a particular pair of lids to nest more closely, creating a varied nesting arrangement which makes it difficult to know the exact number of lids contained in any one stack. A carton of lids containing multiple stacks will not always contain the same amount of lids. Additionally, this configuration does not provide full circumferential support around the entire lid.

In an effort to overcome the aforementioned shortcomings, the thin-walled stackable lid disclosed in U.S. Pat. No. 4,703,857 issued to Jahnen et al. illustrates an anti-nesting structure which enables lateral bottom feed of the lids from a stack of similar lids. The anti-nesting structure includes a sealing rib formed by an outer peripheral wall and an inner peripheral wall as well as an annular bottom wall. Both the inner and outer peripheral walls are tapered outwardly from their top to bottom such that a portion of the lower wall contacts an upper surface of a subsequent lid. However, when lids of this type are formed in a thermoforming process, the lids cannot be readily extracted from the mold and when extracted, often time result in the anti-nesting feature being turned inside out thus destroying the operability of the lid.

Clearly, there is a need for a thin-walled thermoformed lid including an anti-nesting structure which permits the lid to be readily formed by known thermoforming processes and which maintains the overall stability of a stack when lids of similar structure are stacked one upon the other.

SUMMARY OF THE INVENTION

It is an object of the present invention to provide disposable, thin-wall, plastic lids having improved strength against axial deformation and improved stability when stacked one atop the other.

One important object of the present invention is to provide a lid having a negative stack ring with positive draft flutes to allow the lid to strip out of the mold, without requiring a secondary stripping or ejection mechanism.

Another object of the present invention is to provide a lid having a negative stack ring on its inner wall, so that when the plastic material cools the negative stack ring shrinks away from the mold undercut allowing the lid to strip past the mold.

Another object of the present invention is to provide a stack of lids which is resistant to shifting laterally.

Another object of the present invention is to provide a stack of lids having uniform nesting throughout the stack, providing for a consistent case cube due to a more consistent stack count.

Another object of the present invention is to provide a lid which is easier to handle for the machine operator, and easier for the end use operator or customer to separate from the stack.

Another object of the present invention is to provide a lid which has full circumferential support around the entire lid, eliminating the need for multiple staggered stack lug patterns.

Yet another object of the present invention is to provide a lid with a large center panel for logo engraving and improved over-all aesthetics.

These and other objects of the present invention are accomplished by providing a thin walled, plastic lid having a generally circular center portion and an outer rim portion which fits over the cup bead and includes an integral peripheral skirt which makes up the outer sidewall of the lid. Located between the rim portion and the center portion is a recess or annular trough with an inner wall and an outer wall. The outer wall is separated preferably into two shelves and three vertical sections or a variation thereof. The lower shelf serves as a receiver ring upon which the lid above rests. The short vertical section located above the receiver ring effectively prevents any lateral movement of the lid above. The lowest wall section forms the stacking ring and generally has a negative slope toward the lid skirt, however, spaced periodically around the circumference of the stacking ring are positive draft flutes which have a positive slope away from the skirt and toward the center of the lid. The recess has a generally flat bottom which connects the stacking ring to the inner wall. The corner of the lid where the stacking ring and the recess bottom join rests in the receiver ring of the next lower lid in the stack provide uniform nesting and full circumferential support. The inner wall of the recess has a negative slope and connects the bottom of the recess with the generally flat center portion.

A second embodiment of the present invention has a similar lid design. The negative stack ring and the receiver ring are provided on the inner wall of the lid. There are no positive draft flutes provided, in that as the plastic cools during the thermoforming process the negative stack ring will shrink towards the lid center a sufficient distance to allow the lid to clear the undercut of the mold during stripping.

These as well as additional advantages of the present invention will become apparent from the following description when read in light of the several figures.

BRIEF DESCRIPTION OF THE DRAWINGS

FIG. 9 is a top view of the cup lid of FIG. 7.

FIG. 10 is a bottom view of the lid of FIG. 7.

DETAILED DESCRIPTION OF THE PRESENT INVENTION

Referring now to the several figures and particularly FIGS. 1–6, a first embodiment of the present invention will now be described in detail. As discussed hereinabove, the present invention relates to a thin-walled thermoplastic container lid 1 with the lid 1 being formed by known thermoforming processes. The lid is adapted to be received on a container having a curled brim such as that which is well known in the art.

Figure 1:
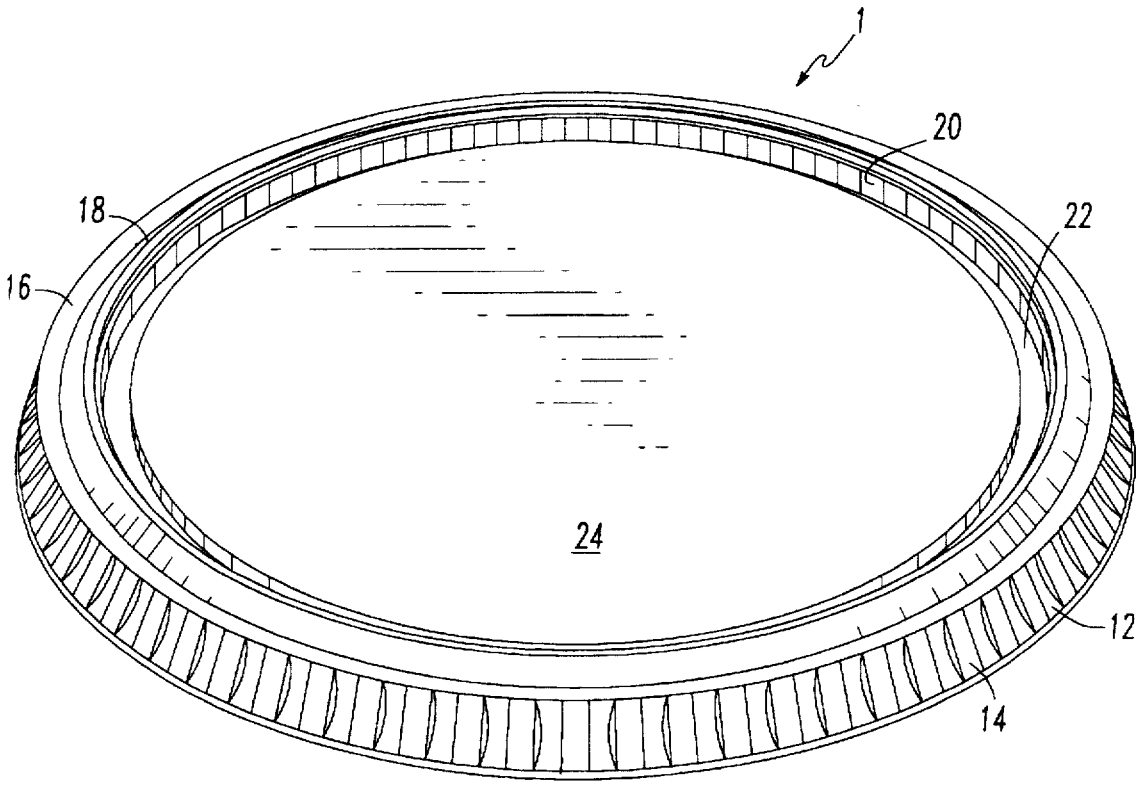
FIG. 1 is a perspective view of a cup lid formed in accordance with the present invention.
Figure 2:
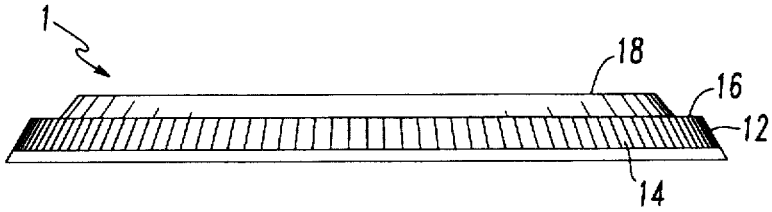
FIG. 2 is a side elevational view of the cup lid of FIG. 1.
Figure 3:
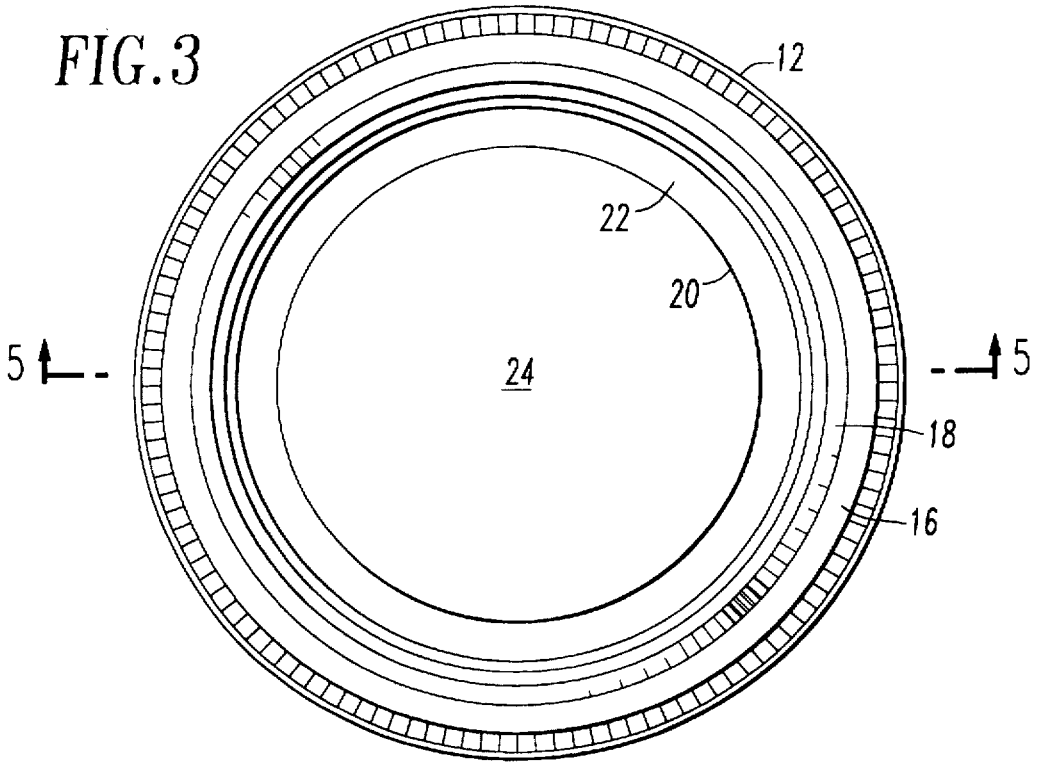
FIG. 3 is a top view of the cup lid of FIG. 1.
Figure 4:
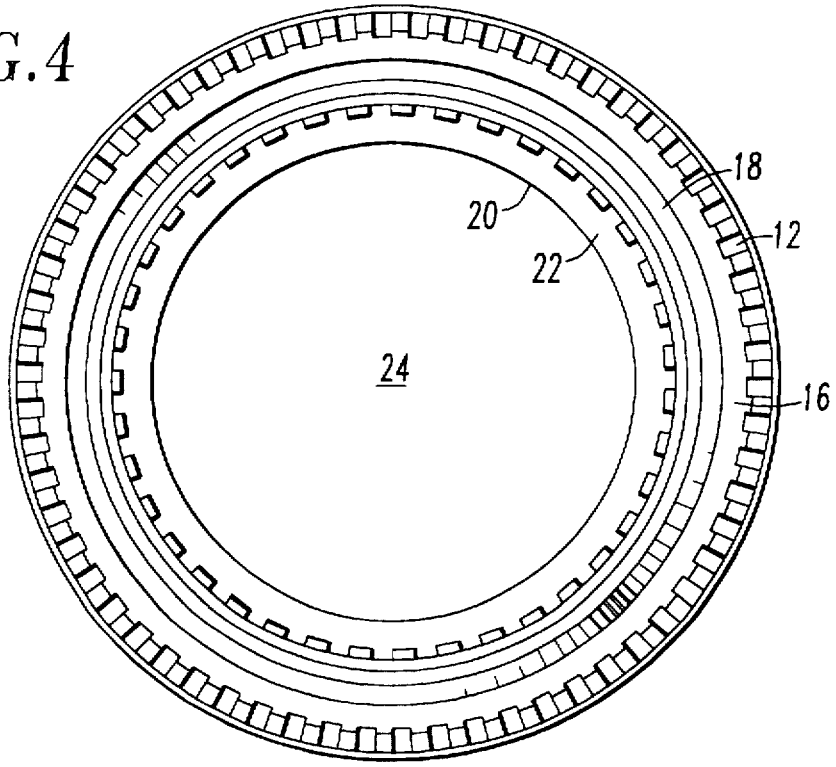
FIG. 4 is a bottom view of the cup lid of FIG. 1.
Figure 5:
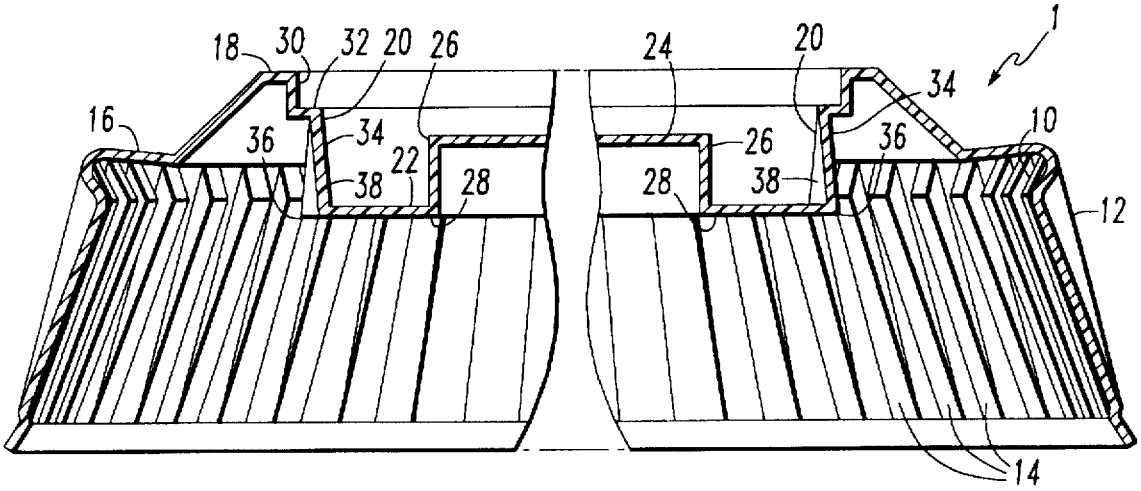
FIG. 5 is a cross-sectional view of the cup lid of FIG. 1 cut diametrically across the cup lid along line 5—5 of FIG. 3.

Referring to FIG. 5, the lid 1 includes a peripherally extending cavity or bead 10 which is formed at an upper and outer extremity the lid for receiving the brim curl of the container to which the lid is to be fitted as discussed hereinabove. The bead 10 opens downwardly and inwardly in order to receive the brim curl. Extending downwardly and outwardly from the bead 10 is skirt 12 which aids in the placement of the lid on a container. That is, when the lid is positioned adjacent the opening of a container and pressed thereon, the incline surfaces 14 of the skirt 12 flex in order to receive the brim curl of the container within the bead 10. Such a feature is well known in the art as illustrated in U.S. Pat. No. 4,421,244 discussed hereinabove.

The skirt 12 and bead 10 are interconnected with the upper portion of the lid by way of surface 16 which also acts to aid in the positioning of the curled brim of the container within the bead 10. In order to add stability to the overall configuration, an annular raised portion 18 is provided. The particular configuration of the raised portion is not critical, however, the inner wall 26 of the annular trough 22 is critical as will be discussed in detail hereinbelow. Accordingly, the raised portion 18 may take on any configuration which is determined to add stability to the overall lid configuration.

A substantially horizontal planar surface 24 is provided in the central region of the lid. This surface may be used for receiving indicia thereon or molded therein as well openings for access to the contents of the container. The particular horizontal positioning of the surface 24 is not critical.

Figure 6:
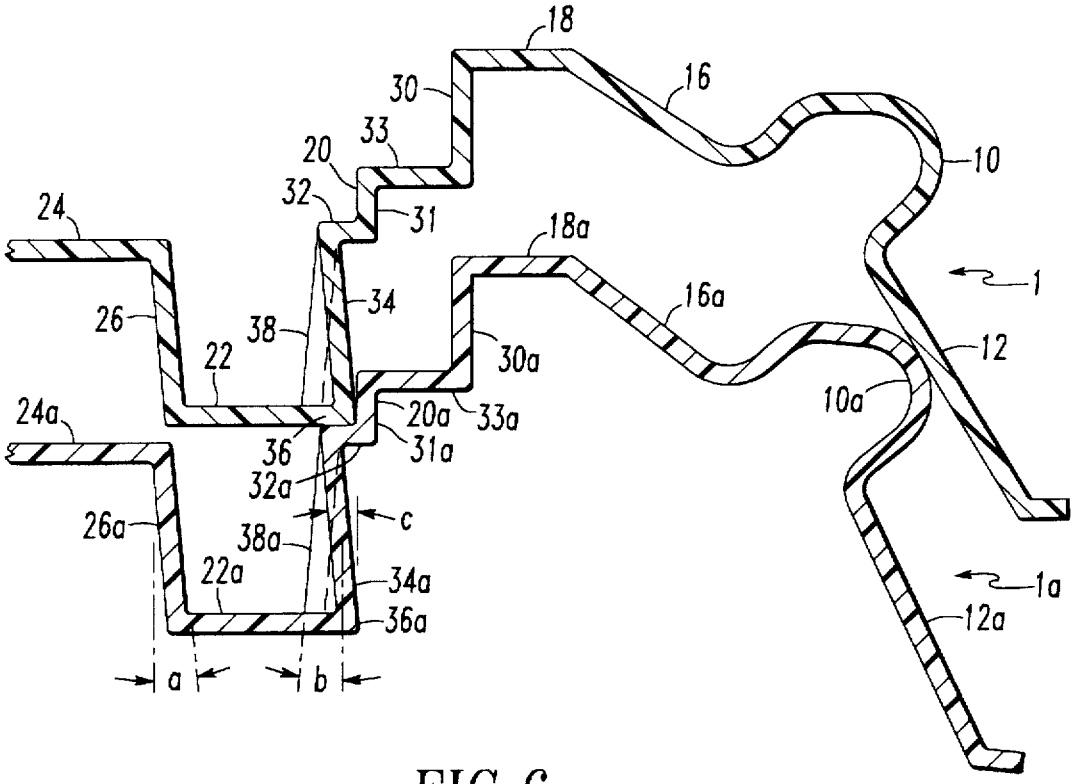
FIG. 6 is a cross-sectional view of two cup lids of FIG. 1 illustrated in their stacked condition.
Figure 7:
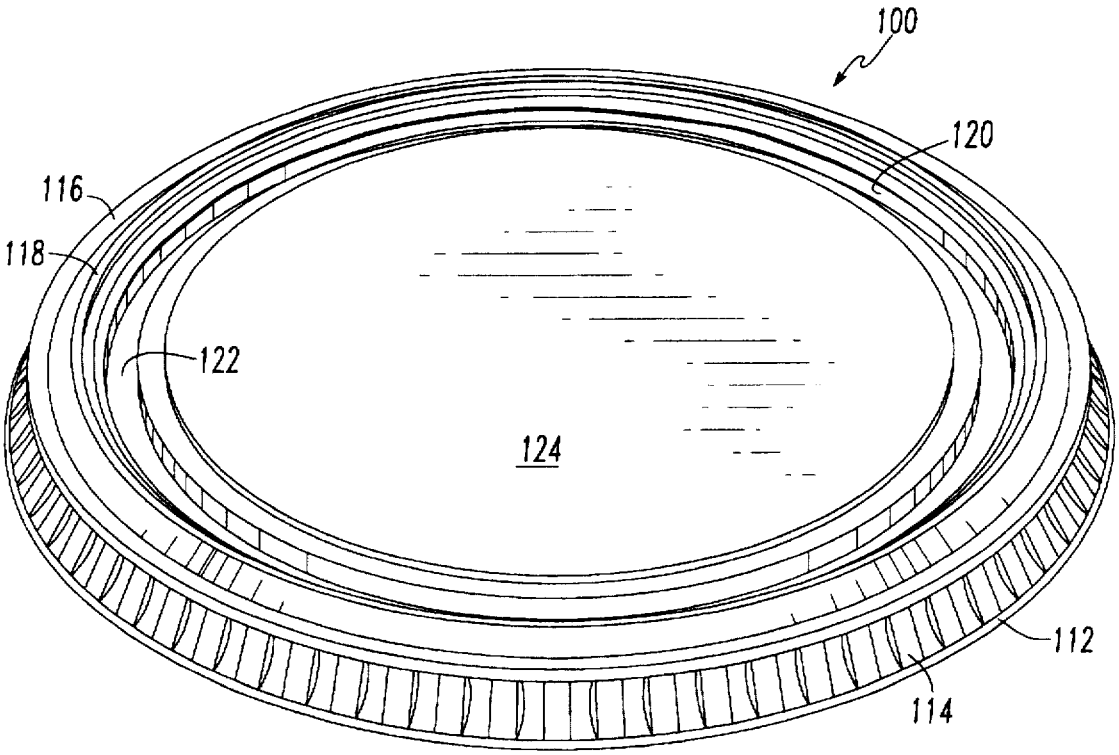
FIG. 7 is a perspective view of a cup lid formed in accordance with an alternative embodiment of the present invention.
Figure 8:
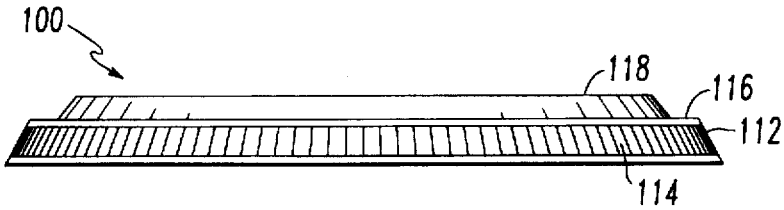
FIG. 8 is a side elevational view of the cup lid of FIG. 7.

As discussed hereinabove, the planar section 24 is interconnected with the raised portion by way of the annular trough 22. The annular trough includes outer wall 20 as well as an inner wall 26 which in conjunction with the bottom wall 28 form the annular trough 22. In accordance with the embodiment illustrated in FIG. 5, the inner wall 26 is substantially vertical and continues about the entire inner parameter of the trough 22. As illustrated in FIG. 6, the inner wall 26 may preferably be angled slightly so as to aid in removal of the finished lid from a mold as well as add stability to the overall structure of the lid.

The outer wall 20 of the annular trough 22 illustrated in FIG. 5 is separated by a single shelf and includes two substantially vertical sections. With respect to the embodiment illustrated in FIG. 6, two shelves are provided with the inner wall being separated into three substantially vertical sections. Again, the added shelf and vertical section adds additional stability to the overall structure of the lid itself as well as aids in removal of a finished lid from the forming device.

With respect to FIG. 6, the vertical wall section 30 limits lateral movement of a cup stacked on top of the lid such as in a bag while the short outer wall 20 is provided in order to limit lateral movement of a subsequent lid placed on the lid illustrated in FIG. 6. Additionally, the shelf 32 is provided to support a subsequent lid which is placed thereon in a manner which is discussed in detail hereinbelow. Further, the lowermost wall section forms a stacking ring including a negative slope outwardly toward the lid skirt. Spaced periodically around the circumference of the stacking ring 36 are positive draft flutes which have a positive slope away from the skirt and towards the center of the lid. In doing so, the integrity of the stacking ring 36 formed during the thermoforming process is maintained when the lid is removed from the forming device. That is, as mentioned hereinabove with respect to the prior art lids, lids having an outer wall sloped substantially toward the skirt when formed and removed from the molding device turn inside out in that the thermoplastic material as it cools contracts and forms tightly against the molding device. Consequently, removal of the lid from the forming device causes the annular trough to be turned inside out. In accordance with the present invention, the positive draft flutes 38 formed about lower wall section 34 of the outer wall 20 maintain the integrity of the stacking ring 36 when removed from the forming device. Accordingly, lids formed in accordance with the present invention including a stacking ring 36 stabilized by positive draft flutes 38 and shelf 32 which in conjunction with one another form an anti-nesting structure which continues around the entire circumference of the lid, results in the formation of a substantially stable stack. Further, because the stacking ring continues completely around the lid and contacts the inner surface of the upper wall section, lateral stability of the stack is also maintained. This feature being best illustrated with reference to FIG. 6.

Referring again to FIG. 6, lids formed in accordance with the structure discussed hereinabove are illustrated in their stacked configuration. Each of the lids 1 and 1*a* include the curled brim receiving recess or bead 10 and 10*a* as well as skirts 12 and 12*a*. Each of lids 1 and 1*a* further include raised portions 18 and 18*a*, annular troughs 22 and 22*a* as well as planar center portions 24 and 24*a*.

Unlike the previous embodiment and as noted hereinabove, the outer wall 20 and 20*a* include three substantially vertical sections, an upper wall section 30, 30*a*, a lower wall section 34 and 34*a*, as well as intermediate wall section 31 and 31*a*. Each of these wall sections are interconnected with one another by way of a lower shelf 32, 32*a* and an upper shelf 33 and 33*a*. As can be readily seen from FIG. 6, the lower shelf 32*a* of lid 1*a* receives the stacking ring 36 of the lid 1 which rests thereon. As discussed hereinabove, the shelf 32*a* provides stacking support to the stacking ring 36 of the lid 1 while the intermediate wall 31*a* provides lateral support to the lid 1 which prevents the lids from shifting laterally and nesting within one another, which would otherwise make it difficult to remove an uppermost or lowermost lid from the stack.

In accordance with the preferred embodiment, the lower wall 34 and 34*a* are inclined at an angle a in the range of 1° to 10° from the vertical and preferably at an angle of 3° shown as angle c in FIG. 6. Similarly, the positive draft flutes 38 and 38*a* are inclined at an angle b with respect to the vertical in the range of 1° to 10° and preferably 5°. Additionally, in the embodiment illustrated in FIG. 6, the inner wall 26 and 26*a* are also inclined at an angle a with respect to the vertical in the range of 1° to 10° and preferably 5°. This results in an anti-nesting structure which provides for a stable and reliable stack which is both axially and laterally supported by way of the stacking ring 36 and shelf 32*a* and intermediate wall 31*a*. Again, while the particular configuration of the overall lid structure is not critical, the formation of the stacking ring 36 including the spaced positive draft flutes 38 formed in the outer wall of the annular trough provides for a lid which can be reliably formed using known thermoforming processes while resulting in a lid which when stacked forms a stable stacked configuration.

Referring now to FIGS. 7–12, an alternative embodiment of the present invention will now be described in greater detail hereinbelow.

The lid configuration illustrated in FIGS. 7–12 is substantially similar to that of the previous embodiments discussed hereinabove. That is, the lid 100 includes a peripherally extending cavity 110 which is formed at an upper and outer extremity of the lid for receiving the brim curl of a container to which the lid is to fitted as previously discussed hereinabove. The bead 110 opens downwardly and inwardly in order to receive the brim curl. Extending downwardly and outwardly from the bead 110 is a skirt 112 which aids in the placement of the lid on the container. As noted hereinabove, when the lid is positioned adjacent the opening of a container and pressed thereon, the incline surfaces 114 of the skirt 112 flex in order to receive the brim curl of the container within the bead 110.

The skirt 112 and bead 110 are interconnected with the upper portion of the lid by way of a surface 116 which also acts to aid in the positioning of the curl brim of a container within the bead 110. Again, in order to add stability to the overall configuration, an annular raised portion 118 is provided. As noted hereinabove, the particular configuration of the raised portion 118 is not critical, however, the annular trough 122 is critical as will be discussed in detail hereinbelow. Accordingly, the raised portion 118 may take on any configuration which is determined to add stability to the overall lid configuration.

A substantially horizontal planar surface 124 is again provided in the central region of the lid. This surface may be used for receiving indicia thereon or molded therein as well as openings for access to the contents of the container. As previously, the particular horizontal positioning of the surface 124 is not critical, however, it must relate to the overall stacking height of the lid.

As discussed hereinabove, positioned between the planar section 124 and the raised portion 118 is the annular trough 122. The annular trough includes an outer wall 120 and an inner wall 126 which in conjunction with the bottom wall 128 form the annular trough 122. In accordance with the embodiment illustrated in FIGS. 11 and 12, the inner wall 126 continues about the entire inner parameter of the trough 122 and is preferably angled slightly inwardly so as to form an anti-nesting structure. Acting in conjunction with the inner side wall 126 is shelf 125 which separates the lowermost portion 127 of the inner side wall from the upper portion 129 of the inner side wall 126. As can be seen from FIG. 12, when lids of like configuration are placed one on top of the other, a stacking ring 136 formed by the inner section of the lowermost section 127 of the inner wall 126 and the bottom wall 128 of the annular trough 122 contacts an upper surface of the shelf 125 in order to position adjacent lids with respect to one another. Additionally, the upper section 129 of side wall 126 cooperates to laterally align and stabilize the lids with respect to one another.

Figure 11:
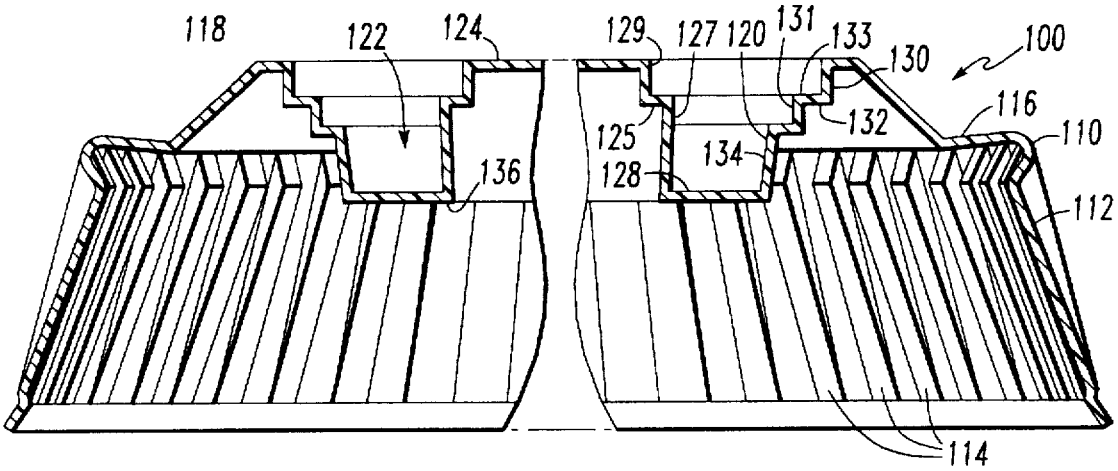
FIG. 11 is a cross-sectional view of the lid of FIG. 7 cut diametrically across the cup lid along line 11—11 of FIG. 9.

The outer wall 120 of the annular trough 122 illustrated in FIG. 11 is separated by shelves 132 and 133 into an upper section 130 which controls lateral movement of cup-on-lid stacking, a lower section 134, and an intermediate section 131. These shelves add additional stability to the overall structure of the lid itself as well as aids in the removal of a finished lid from the forming device. As can be readily seen from FIGS. 11 and 12, the lower portion 134 of the outer wall 120 is inclined radially inwardly with respect to a central axis of the lid at an angle a in the range of 1° to 10° and preferably 7°. Likewise, the lower portion 127 of the inner wall 126 is inclined radially inwardly with respect to the central axis of the lid at an angle b in the range of 1° to 10° and preferably 3°.

When thermoforming a lid in accordance with the present invention, by providing the anti-nesting structure on the inner sidewall 126 of the trough 122 permits the formed lid to be readily removed from the forming device. That is, once the lid is thermoformed, the material forming the inner wall 126 shrinks and draws away from the forming mandrel toward the lid centerline. Consequently, the lid can be readily removed from the forming mandrel even though the inner wall is inclined inwardly. Moreover, the inclination of the outer wall further aids in removal of the formed lid from the forming mandrel. Accordingly, lids formed in accordance with the alternative embodiment of the present invention including a stacking ring 136 and shelf 125 which in conjunction with one another form an anti-nesting structure which continues around the entire circumference of the lid, results in the formation of a substantially stable stack. Further, because the stacking ring continues completely around the lid and contacts an outer surface of the upper section of the inner wall 129, lateral stability of the stack is also maintained. These features are particularly illustrated with reference to FIG. 12.

Figure 12:
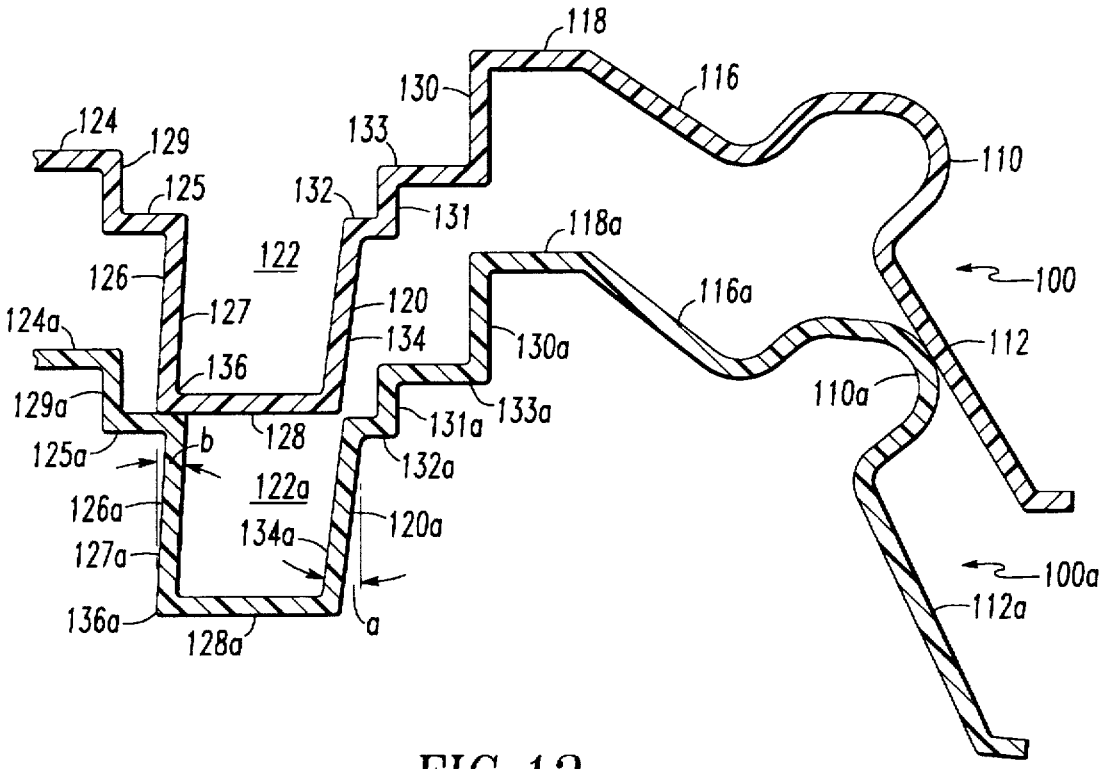
FIG. 12 is a cross-sectional view of two cup lids of FIG. 7 illustrated in their stacked configuration.

Referring now to FIG. 12, lids formed in accordance with the structure discussed hereinabove with respect to FIGS. 7–11 are illustrated in their stacked configuration. Each of the lids 100 and 100*a* include the curl brim receiving recess or bead 110 and 110*a* as well as skirts 112 and 112*a*. Each of the lids further include raised portions 118 and 118*a*, annular troughs 122 and 122*a* as well as planar central portions 124 and 124*a*. As discussed previously, the outer wall 120 and 120*a* include upper wall sections 130 and 130*a*, lower wall sections 134 and 134*a* as well as intermediate wall sections 131 and 131*a*. Each of these wall sections are interconnected with one another by way of shelves 132, 132*a* and shelves 133 and 133*a*. Additionally, as discussed hereinabove, the inner walls 126 and 126*a* are formed of two substantially vertical sections 127, 127*a* and 129, 129*a*. Further, these sections are interconnected with one another by way of shelves 125 and 125*a*. It is the shelf 125*a* which provides stacking support to the stacking ring 136 of the lid 100 while the upper wall section 129*a* of the lid 100*a* provides lateral support to the lid 100 which prevents the lids from shifting laterally and nesting with one another which otherwise would make it difficult to remove the uppermost or lowermost lids from the stack.

Accordingly, by forming lids in accordance with initial embodiments discussed hereinabove, a negative stacking ring with positive draft flutes allows the lid to be stripped out of a mold without requiring a secondary stripping or injection mechanism. Further, in accordance with an alternative embodiment, a lid having a negative stacking ring on its inner walls so that when the plastic material cools, the negative stacking ring shrinks away from the mold undercut thus allowing the lid to be stripped past the mold is likewise provided. Additionally, by forming lids in accordance with the present invention, a lid which has a full circumferential support around the entire lid, thus eliminating the need for multiple staggered stack lug patterns is achieved which further provides for lids having uniform nesting throughout the stack which provides a consistent case cube due to more consistent stack count which allows for easier handling by a machine operator as well as easier end use by an operator or consumer to separate the lids from the stack.

While the present invention has been described with reference to preferred embodiments, it will be appreciated by those skilled in the art that the invention may be practiced otherwise than as specifically described herein without departing from the spirit and scope of the invention. It is, therefore, to be understood that the spirit and scope of the invention be limited only by the appended claims.

We claim:

1. A lid for containers having a curled brim for receiving the lid, comprising:

a substantially horizontal planar central panel;

an annular trough region surrounding said central panel including a bottom wall, an inner side wall and an outer side wall;

an anti-nesting means formed in one of said inner and outer side walls of said annular trough for preventing lids stacked upon one another from nesting; and an annular curled brim receiving region surrounding said annular trough for receiving the curled brim of the container;

wherein said anti-nesting means includes a plurality of alternating radially inwardly and radially outwardly extending portions, said portions extending axially downwardly from an upper limit to a lower limit, said upper limit of said radially inwardly and outwardly extending portions lying in the same circle, said lower limit of said radially inwardly extending portions being spaced radially inwardly of said circle and said lower limit of said radially outwardly extending portions being spaced radially outwardly of said circle.

2. The lid as defined in claim 1, wherein said anti-nesting means is formed in said outer side wall of said annular trough.

3. The lid as defined in claim 2, wherein said outer side wall includes at least two upstanding sections and at least one substantially horizontal section extending between said upstanding sections with said radially outwardly extending portions and said radially inwardly extending portions being formed in one of said upstanding sections.

4. The lid as defined in claim 3, wherein said radially outwardly extending portions and said radially inwardly extending portions are formed in a lowermost of said upstanding sections with respect to said annular trough.

5. The lid as defined is claim 4, wherein a lowermost portion of said radially outwardly extending portions of a first lid in a stack of lids contacts said substantially horizontal section of a next lid in the stack of lids.

6. The lid as defined in claim 1, wherein said anti-nesting means is formed in said inner side wall of said annular trough.

7. A lid for containers having a curled brim for receiving the lid, comprising:

a substantially horizontal planar central portion;

an annular trough region surrounding said central region including a bottom wall, an inner side wall and an outer side wall, said outer side wall including at least two upstanding sections and at least one substantially horizontal section extending between said upstanding sections;

an anti-nesting means formed in a lowermost one of said at least two upstanding sections for preventing lids stacked upon one another from interlocking with one another; said anti-nesting means includes a plurality of alternating radially inwardly and radially outwardly extending portions, said portions extending axially downwardly from an upper limit to a lower limit, wherein a radial distance between said upper limit of said radially inwardly or radially outwardly extending portions and a circle is less than a radial distance between said lower limit of said radially inwardly or outwardly extending portions and said circle; and an annular curled brim receiving region surrounding said annular trough for receiving the curled brim of the container.

8. The lid as defined is claim 7, wherein a lowermost portion of said radially outwardly extending portions of a first lid in a stack of lids contacts said substantially horizontal section of a next lid in the stack of lids.

9. The lid as defined in claim 7, wherein said plurality of radially outwardly extending portions are inclined at an angle in the range of 1° to 10° with respect to a central axis of the lid.

10. The lid as defined in claim 9, wherein said angle is 3°.

11. The lid as defined in claim 9, wherein said plurality of radially inwardly extending portions are inclined at an angle in the range of 1° to 10° with respect to a central axis of the lid.

12. The lid as defined in claim 11, wherein said angle is 5°.

13. The lid as defined in claim 7, wherein said inner side wall is inclined radially outwardly at an angle in the range of 1° to 10° with respect to a central axis of the lid.

14. The lid as defined in claim 13, wherein said angle is 5°.

15. The lid as defined in claim 7, wherein said upper limit of both said radially outwardly extending portion and said radially inwardly extending portion are circumferentially aligned with one another.

16. A lid for containers having a curled brim for receiving the lid, comprising:

a substantially horizontal planar central panel;

an annular trough region surrounding said central panel including a bottom panel, an inner side wall and an outer side wall; said inner side wall including at least two upstanding sections and at least one substantially horizontal section extending between said upstanding sections;

an anti-nesting means formed in said inner side wall for preventing lids stacked upon one another from interlocking with one another, said anti-nesting means including at least a portion of a lowermost one of said upstanding sections tapering radially inwardly toward a central axis of the lid from a top to a bottom of said annular trough;

an annular curled brim receiving region or bead surrounding said annular trough for receiving the curled brim of the container.

17. The lid as defined in claim 16, wherein the lowermost one of said upstanding sections tapers radially inwardly at an angle in the range of 1° to 10° with respect to a central axis of the lid.

18. The lid as defined in claim 17, wherein said angle is 3°.

19. The lid as defined in claim 16, wherein a lowermost portion of said lowermost of said upstanding sections of a first lid in a stack of lids contacts said substantially horizontal section of a next lid in the stack of lids.

20. The lid as defined in claim 17, wherein said outer side wall includes at least two upstanding sections and at least one substantially horizontal section extending between said substantially vertical sections.

21. The lid as defined in claim 20, wherein a lowermost one of said upstanding sections is inclined radially inwardly at an angle in the range of 1° to 10° with respect to the central axis of the lid.

22. The lid as defined in claim 21, wherein the angle is 5°.

23. A lid for containers having a curled brim for receiving the lid, comprising:

a substantially horizontal planar central panel;

an annular trough region surrounding said central panel including a bottom wall, an inner side wall and an outer side wall;

an anti-nesting means formed in said inner wall of said annular trough for preventing lids stacked upon one another from nesting; and an annular curled brim receiving region or bead surrounding said annular trough for receiving the curled brim of the container;

wherein said anti-nesting means includes at least two upstanding sections and at least one substantially horizontal section extending between said upstanding sections with a lowermost of said upstanding sections tapering radially inwardly toward a central axis of the lid from a top to a bottom of said annular trough.

24. The lid as defined in claim 23, wherein a lowermost portion of said lowermost of said upstanding sections of a first lid in a stack of lids contacts said substantially horizontal section of a next lid in the stack of lids.

* * * * *

UNITED STATES PATENT AND TRADEMARK OFFICE

CERTIFICATE OF CORRECTION

PATENT NO. : 5,791,509
DATED : August 11, 1998
INVENTOR(S) : Jonathan Edward Rush et al.

It is certified that error appears in the above-identified patent and that said Letters Patent is hereby corrected as shown below:

Column 8,
Line 46, change “portion” to -- region --.

Column 10,
Line 8, delete “of said lowermost”.
Line 14, change “substantially vertical” to -- upstanding --.
Line 39, delete “of said lowermost”.

Signed and Sealed this

Twenty-second Day of April, 2003

JAMES E. ROGAN
*Director of the United States Patent and Trademark Office*